US011391468B2

(12) United States Patent
Yang et al.

(10) Patent No.: US 11,391,468 B2
(45) Date of Patent: Jul. 19, 2022

(54) COOKING DEVICE

(71) Applicant: LG ELECTRONICS INC., Seoul (KR)

(72) Inventors: Ingyu Yang, Seoul (KR); Hyunwoo Park, Seoul (KR); Jongho Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 450 days.

(21) Appl. No.: 16/172,628

(22) Filed: Oct. 26, 2018

(65) Prior Publication Data

US 2019/0063757 A1 Feb. 28, 2019

Related U.S. Application Data

(62) Division of application No. 15/061,607, filed on Mar. 4, 2016, now Pat. No. 10,145,567.

(30) Foreign Application Priority Data

Mar. 6, 2015 (KR) ..... 10-2015-0031572

(51) Int. Cl.
*F24C 15/32* (2006.01)

(52) U.S. Cl.
CPC ..... *F24C 15/322* (2013.01)

(58) Field of Classification Search
CPC ..... F24C 15/322
See application file for complete search history.

(56) References Cited

U.S. PATENT DOCUMENTS 4,515,143 A * 5/1985 Jabas ..... A21B 1/22 126/21 A
4,826,837 A 5/1989 Doria ..... C07D 237/28 514/217.05
4,867,132 A * 9/1989 Yencha ..... F24C 15/322 126/21 A (Continued)

FOREIGN PATENT DOCUMENTS

KR 10-0735184 B1 7/2007
KR 10-0789831 B1 1/2008

(Continued)

OTHER PUBLICATIONS

U.S. Appl. No. 15/061,607, filed Mar. 4, 2016.

*Primary Examiner* — Edelmira Bosques
*Assistant Examiner* — Deepak A Deean
(74) *Attorney, Agent, or Firm* — Dentons US LLP

(57) ABSTRACT

A cooking device comprises a frame including supporting parts to support a tray on which food is put; a partitioning plate to divide an inner space of the frame into a cooking chamber and an air flow chamber; a burner in the air flow chamber; and a fan in the air flow chamber, wherein the partitioning plate includes an air inlet to introduce air inside the cooking chamber into the air flow chamber, and air outlets to discharge air heated by the burner in the air flow chamber to the cooking chamber, and the air outlets include a first air outlet and a second air outlet located at a lower level than the first air outlet, at least a part of the second air outlet is located at a lower level than the tray while the tray is supported by a lowermost supporting part of the supporting parts.

16 Claims, 12 Drawing Sheets

(56) References Cited

U.S. PATENT DOCUMENTS 8,106,334 B2 * 1/2012 Nam ..... F24C 15/322 219/400
2003/0140917 A1 * 7/2003 Rummel ..... F24C 15/322 126/21 A
2006/0131298 A1 6/2006 Seuk Oh ..... F24C 15/325 219/400
2006/0169272 A1 * 8/2006 McFadden ..... H05B 6/6473 126/21 A
2006/0278214 A1 12/2006 Park ..... F24C 15/006 126/273 R
2007/0181558 A1 * 8/2007 Kim ..... F24C 15/322 219/400
2008/0105249 A1 * 5/2008 McFadden ..... H05B 6/6473 126/21 A
2009/0032521 A1 2/2009 Kim ..... F24C 15/18 219/400
2009/0045184 A1 * 2/2009 Nam ..... F24C 15/322 219/400
2009/0090347 A1 4/2009 Kim ..... F24C 7/082 126/21 A
2010/0003387 A1 * 1/2010 Knight ..... F24C 15/322 426/523
2010/0147280 A1 6/2010 Bonuso ..... F24C 15/325 126/21 A
2013/0175253 A1 * 7/2013 Shei ..... A47J 39/003 219/400
2013/0291854 A1 * 11/2013 Johnson ..... F24C 15/16 126/21 A

FOREIGN PATENT DOCUMENTS

KR 10-2009-0017299 A 2/2009
KR 10-2014-0067731 A 6/2014

* cited by examiner

COOKING DEVICE

CROSS-REFERENCE TO RELATED APPLICATION(S)

This application is a Divisional of U.S. patent application Ser. No. 15/061,607, filed on Mar. 4, 2016, now allowed, which claims priority under 35 U.S.C. 119 and 35 U.S.C. 365 to Korean Patent Application No. 10-2015-0031572, filed on Mar. 6, 2015, all of which are hereby incorporated by reference in their entirety.

BACKGROUND

1. Field

A cooking device is disclosed herein.

2. Background

A cooking device is a device for cooking food using heat of a heating source. As an example of the cooking device, an oven range includes an oven chamber in which the food is cooked, and a burner which cooks the food in the oven chamber by burning a gas.

In Korean Patent Publication No. 10-2010-0013997 (published on Feb. 10, 2010) as a prior art document, there is disclosed an oven range.

In the oven range, a burner chamber is provided under a bottom surface thereof which forms an oven chamber, and a lower burner which convectively heats food in the oven chamber is installed in the burner chamber.

The oven range in the prior art document has the following problems.

First, as described above, to provide air heated by the lower burner from the burner chamber into the oven chamber, the oven chamber and the burner chamber are in communication with each other. However, since the burner chamber is provided under the oven chamber, a part of the bottom surface of the oven chamber should be open.

When a part of the bottom surface of the oven chamber is open, food leftovers or the like may be introduced into the burner chamber through an open portion of the oven chamber in communication with the burner chamber when the food is cooked in the oven chamber or the food is put into or taken out of the oven chamber. Therefore, a product may be contaminated by the food leftovers or the like.

Also, since a part of the bottom surface of the oven chamber is open, it is not easy to clean the oven chamber due to an opening of the bottom surface.

Also, since the lower burner is installed under the oven chamber, a cavity capacity is reduced by a burner installation space.

Also, in the case in which the lower burner is installed at an outer side of the oven chamber, when it is necessary to replace or check an ignition unit for igniting a mixed gas supplied to the lower burner, an outer case which surrounds the oven chamber should be separated therefrom, and thus an operation therefor is complicated, and much time is spent.

SUMMARY

The present invention is directed to a cooking device.

A cooking device comprises a frame including a plurality of supporting parts to support a tray on which food is put, the plurality of supporting parts being vertically separated from each other; a partitioning plate configured to divide an inner space of the frame into a cooking chamber and an air flow chamber in the frame; a burner disposed in the air flow chamber; and a fan disposed in the air flow chamber, wherein the partitioning plate includes an air inlet configured to introduce air inside the cooking chamber into the air flow chamber, and a plurality of air outlets configured to discharge air heated by the burner disposed in the air flow chamber to the cooking chamber, and the plurality of air outlets include a first air outlet and a second air outlet located at a lower level than the first air outlet, wherein at least a part of the second air outlet is located at a lower level than the tray while the tray is supported by a lowermost supporting part of the plurality of supporting parts.

A cooking device includes a frame configured to accommodate food; a partitioning plate configured to divide an inner space of the frame into a cooking chamber and an air flow chamber in the frame; a burner disposed in the air flow chamber; and a fan disposed in the air flow chamber, wherein the partitioning plate includes an air inlet configured to introduce air inside the cooking chamber into the air flow chamber, and a plurality of air outlets configured to discharge air heated by the burner disposed in the air flow chamber to the cooking chamber, wherein the plurality of air outlets include a first air outlet and a second air outlet located at a lower level than the first air outlet, wherein a width of the second air outlet is greater than a width of the first air outlet, and a length of the second air outlet is smaller than a length of the first air outlet.

BRIEF DESCRIPTION OF THE DRAWINGS

Embodiments will be described in detail with reference to the following drawings in which like reference numerals refer to like elements, and wherein.

DETAILED DESCRIPTION

Figure 1:
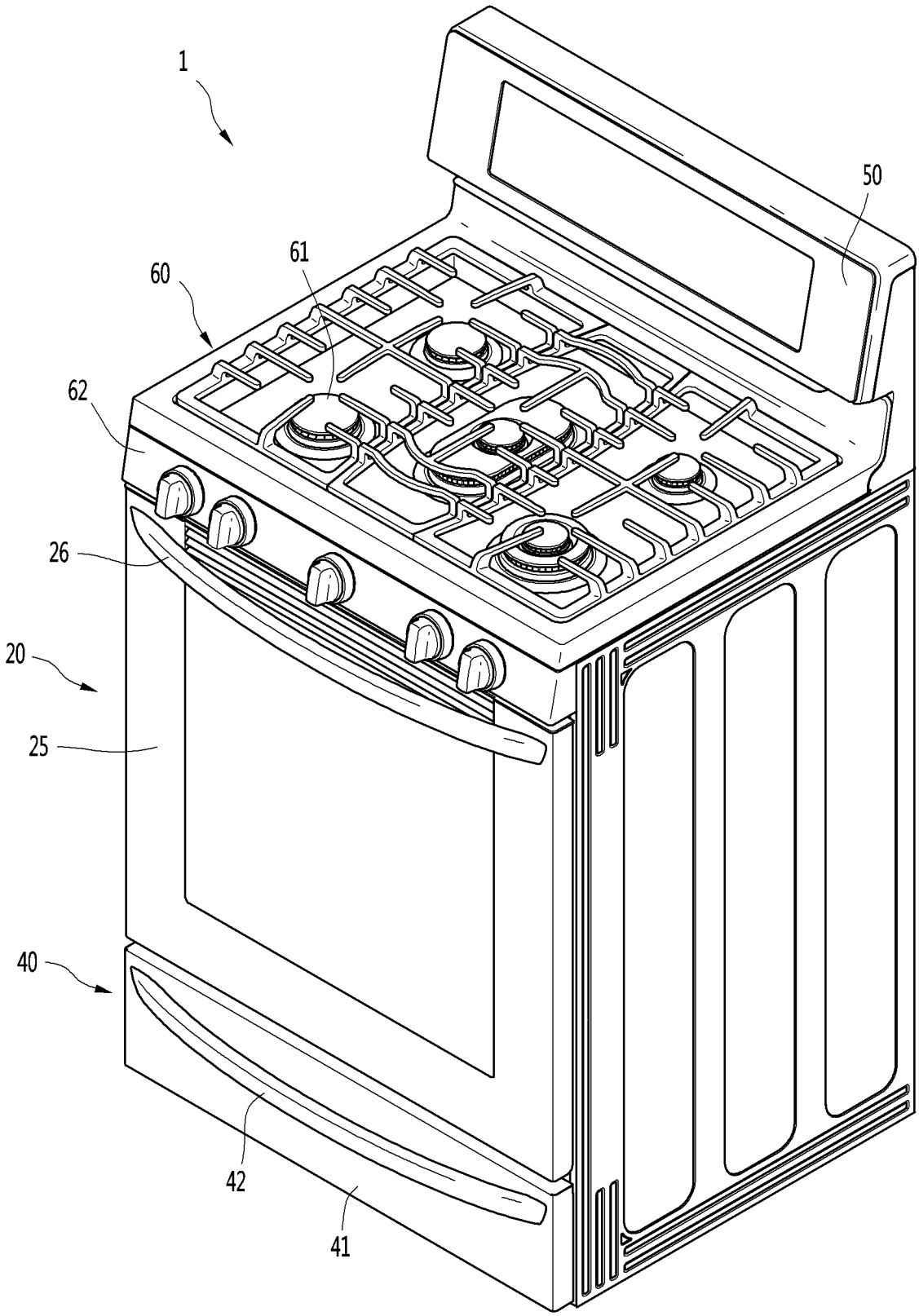
FIG. 1 is a perspective view of a cooking device according to a first embodiment of the present invention.

Reference will now be made in detail to the embodiments of the present disclosure, examples of which are illustrated in the accompanying drawings.

Hereinafter, exemplary embodiments of the present disclosure will be described with reference to the accompanying drawings. Regarding the reference numerals assigned to the elements in the drawings, it should be noted that the same elements may be designated by the same reference numerals, wherever possible, even though they are shown in different drawings. Also, in the description of embodiments, detailed description of well-known related structures or functions may be omitted when it is deemed that such description may cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected," "coupled," and "joined" to the latter via another component.

Figure 2:
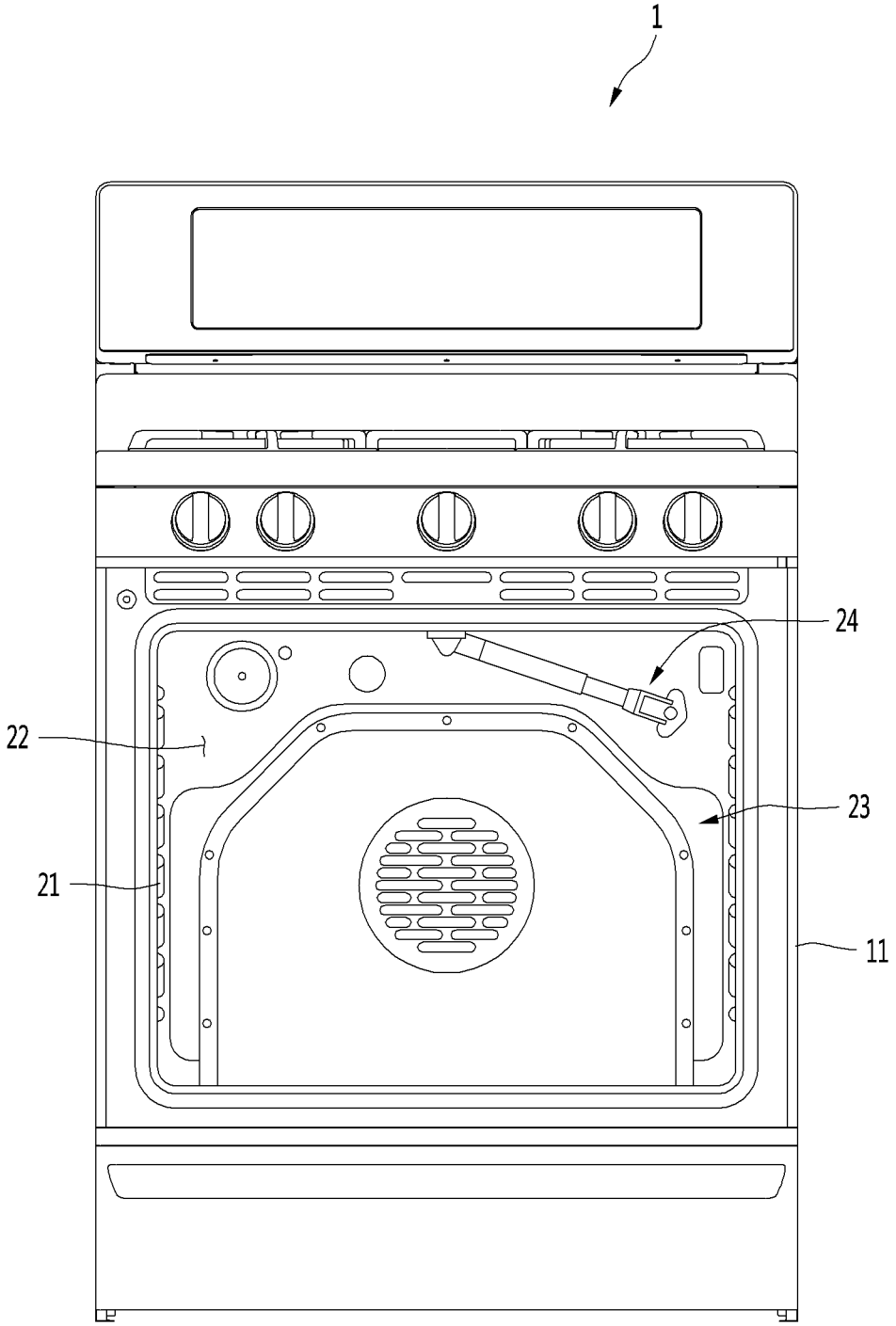
FIG. 2 is a front view when a door is removed from the cooking device according to the first embodiment of the present invention.

FIG. 1 is a perspective view of a cooking device according to a first embodiment of the present invention, and FIG. 2 is a front view when a door is removed from the cooking device according to the first embodiment of the present invention.

Referring to FIGS. 1 and 2, a cooking device 1 according to the first embodiment of the present invention may include an oven unit 20.

The cooking device 1 may further include a cook-top unit 60. The cooking device 1 may further include a drawer unit 40. The cooking device 1 may further include a control unit 50.

The cooking device 1 may further include an outer case 11. The outer case 11 may cover both side surfaces and rear surfaces of the oven unit 20 and the drawer unit 40.

However, the cook-top unit 60 and the drawer unit 40 may be omitted according to a type of the cooking device 1.

The cook-top unit 60, the oven unit 20, and the drawer unit 40 may be disposed at an upper portion, a center portion, and a lower portion of the cooking device 1, respectively. Further, the control unit 50 is disposed at a rear portion of an upper surface of the cooking device 1.

The cook-top unit 60 may include a plurality of cook-top burners 61. The cook-top burners 61 may heat a container in which food is put or may directly heat the food using a flame generated by burning a gas, and thus may cook the food. An operational unit 62 which operates the plurality of cook-top burners 61 may be disposed at a front end of the cook-top unit 60. Alternatively, the operational unit 62 may be disposed at an upper surface of the cook-top unit 60.

As another example, the cook-top unit 60 may include one or more electric heaters. However, the one or more electric heaters may not be exposed to the outside of the cook-top unit 60. Therefore, in the embodiment, a type of a heating source forming the cook-top unit 60 is not limited.

The oven unit 20 may include a frame 21 forming a cooking chamber 22 in which the cooking of food is performed.

For example, the frame 21 may be formed in a rectangular parallelepiped shape of which a front surface is open, but is not limited thereto.

The oven unit 20 may further include a burner assembly 23 for cooking the food accommodated in the cooking chamber 22. The oven unit 20 may further include an upper burner 24.

The burner assembly 23 and the upper burner 24 may simultaneously heat the food, or any one of the burner assembly 23 and the upper burner 24 may heat the food.

The upper burner 24 provides heat to the food from above the food in the frame 21, and the burner assembly 23 may be disposed at the rear of the food in the frame 21.

For example, the upper burner 24 may be installed at an upper wall of the frame 21, and the burner assembly 23 may be installed at a rear wall of the frame 21.

The oven unit 20 may further include a door 25 which opens and closes the cooking chamber 22. The door 25 may be rotatably connected to the cooking device 1. For example, the door 25 opens and closes the cooking chamber 22 in a pull-down method in which an upper end is vertically rotated about a lower end. In the embodiment, an operating method of the door 25 is not limited.

A door handle 26 gripped by a user' hand to rotate the door 25 may be provided at an upper end of a front surface of the door 25.

The drawer unit 40 serves to keep the container, in which the food is put, at a predetermined temperature. A drawer 41 in which the container is accommodated may be provided at the drawer unit 40. The drawer 41 may be inserted into or withdrawn from the cooking device 1 in a sliding method. A handle 42 gripped by the user may be provided at a front surface of the drawer 41.

The control unit 50 may receive an operation signal for operating the cooking device 1, specifically, an operation signal for operating at least one of the cook-top unit 60, the oven unit 20 and the drawer unit 40. Further, the control unit 50 may display a variety of information on the operation of the cooking device 1 to the outside.

Figure 3:
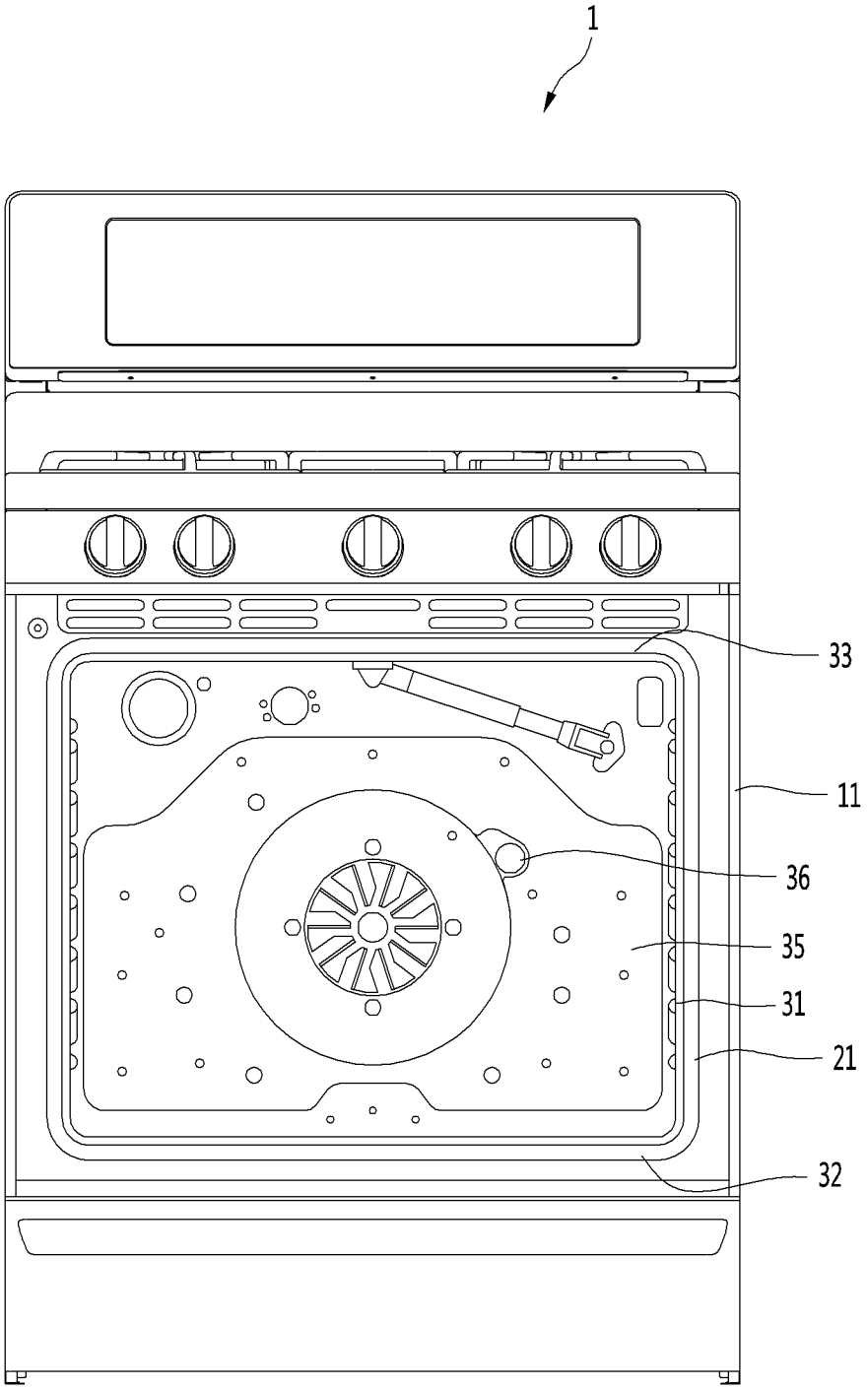
FIG. 3 is a view when a burner assembly is removed from the cooking device shown in FIG. 2.
Figure 4:
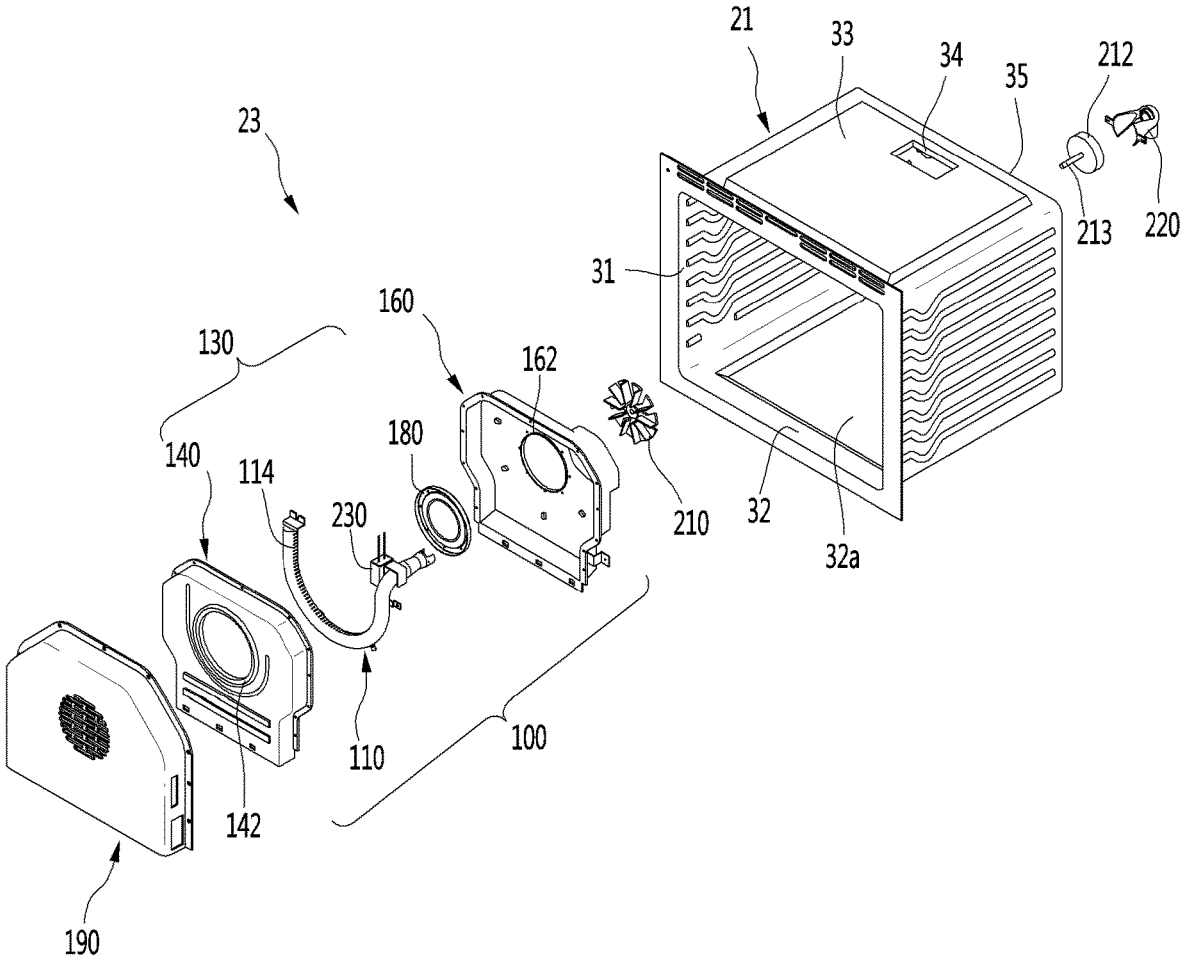
FIG. 4 is an exploded perspective view of the burner assembly according to the first embodiment of the present invention.

FIG. 3 is a view when the burner assembly is removed from the cooking device shown in FIG. 2, and FIG. 4 is an exploded perspective view of the burner assembly according to the first embodiment of the present invention.

Referring to FIGS. 2 to 4, the frame 21 may include two sidewalls 31, a bottom wall 32, an upper wall 33, and a rear wall 35.

In the embodiment, the term "front" is a direction toward a front surface of the cooking device 1, and the term "rear" is a direction toward a rear surface of the cooking device 1.

Further, in the cooking chamber 22, the term "front" is a direction toward the door 25 of the oven unit 20, and the term "rear" is a direction toward the rear wall 35 of the frame 21.

The burner assembly 23 may be coupled to the rear wall 35 of the frame 21. That is, in the embodiment, since the burner assembly 23 is not located under the frame 21 but is installed at the rear wall 35 of the frame 21, a recessed portion 32*a* recessed downward may be formed at the bottom wall 32 of the frame 21, and thus a capacity of the frame 21 may be increased.

Although the above-described burner assembly 23 is installed at the rear wall 35 of the frame 21, alternatively, the burner assembly 23 may also be installed at any one of both of the sidewalls 31 of the frame 21.

The burner assembly 23 may include a burner device 100. The burner device 100 may include a burner 110 which generates a flame by burning a gas, and a burner cover 130 which covers the burner 110.

The burner assembly 23 may further include a partitioning plate 190 which covers the burner device 100 and divides an inner space of the frame 21 into a plurality of spaces.

The burner assembly 23 may further include a fan 210 and a fan motor 212.

The burner assembly 23 may further include a nozzle holder 220 for injecting the gas to the burner 110.

The nozzle holder 220 may be located between the rear wall 35 of the frame 21 and the outer case 11, and may be fixed to, for example, the rear wall 35 of the frame 21. As another example, when an insulating material is displaced on the outer side of the frame 21, the nozzle holder 220 may be displaced on the insulating material.

The nozzle holder 220 may be arranged with the burner 110 passing through the rear wall 35 of the frame 21 and may inject the gas to the burner 110.

In the embodiment, the term "located in a frame" refers to the term "located in a space in which the frame is formed."

A burner hole 36 through which the burner 110 passes may be formed in the rear wall 35 of the frame 21. That is, the burner 110 may be located in the frame 21 and a part thereof may pass through the burner hole 36 to be located between the rear wall 35 of the frame 21 and the outer case 11.

An exhaust hole 34 through which an exhaust gas is discharged may be formed in the upper wall 33 of the frame 21. Alternatively, the exhaust hole 34 may not be formed in the upper wall 33, but may also be formed in the rear wall 35 or one of both of the sidewalls 31 of the frame 21.

The burner cover 130 may include a first cover 140 and a second cover 160. For example, at least a part of the first cover 140 may cover the front of the burner 110, and at least a part of the second cover 160 may cover the rear of the burner 110.

The burner 110 may be formed in a "U" shape, but is not limited thereto. One end of the burner 110 may be connected to the nozzle holder 220. The other end of the burner 110 may be blocked.

The burner 110 may include a plurality of gas discharge holes 114 for discharging the gas (i.e., a mixed gas in which air and a gas are mixed.).

The first cover 140 may include a first opening 142 through which air passes, and the second cover 160 may include a second opening 162 through which the air passes.

The burner device 100 may further include an ignition unit 230 for igniting the mixed gas supplied to the burner 110.

The burner device 100 may further include a stabilizer 180 for stabilizing the flame generated from the burner 110.

For example, the ignition unit 230 may be installed on the burner 110 in the frame 21. When the ignition unit 230 is installed on the burner 110, at least a part of the ignition unit 230 may be located in the burner cover 130.

The fan motor 212 may be located between the rear wall 35 of the frame 21 and the outer case 11, and the fan 210 may be located in the frame 21. Therefore, a shaft 213 of the fan motor 212 may pass through the rear wall 35 of the frame 21 and may be coupled to the fan 210. The fan motor 212 may be fixed to the rear wall 35 of the frame 21 or the outer case 11 by a motor mount which is not shown.

The partitioning plate 190 may protect the burner device 100. Further, the partitioning plate 190 may block the movement of food leftovers or the like to the burner device 100 during a process of cooking food.

Figure 5:
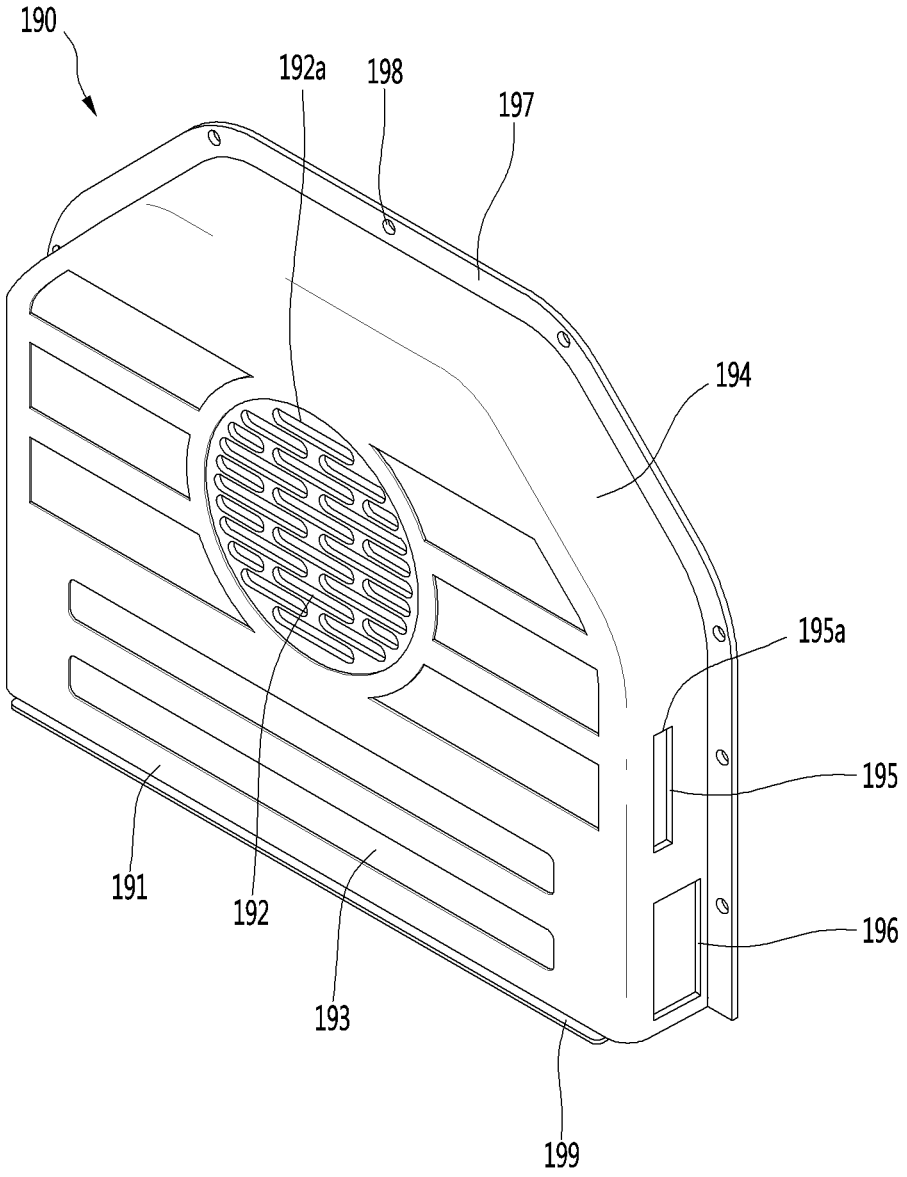
FIG. 5 is a perspective view of a partitioning plate according to the first embodiment.
Figure 6:
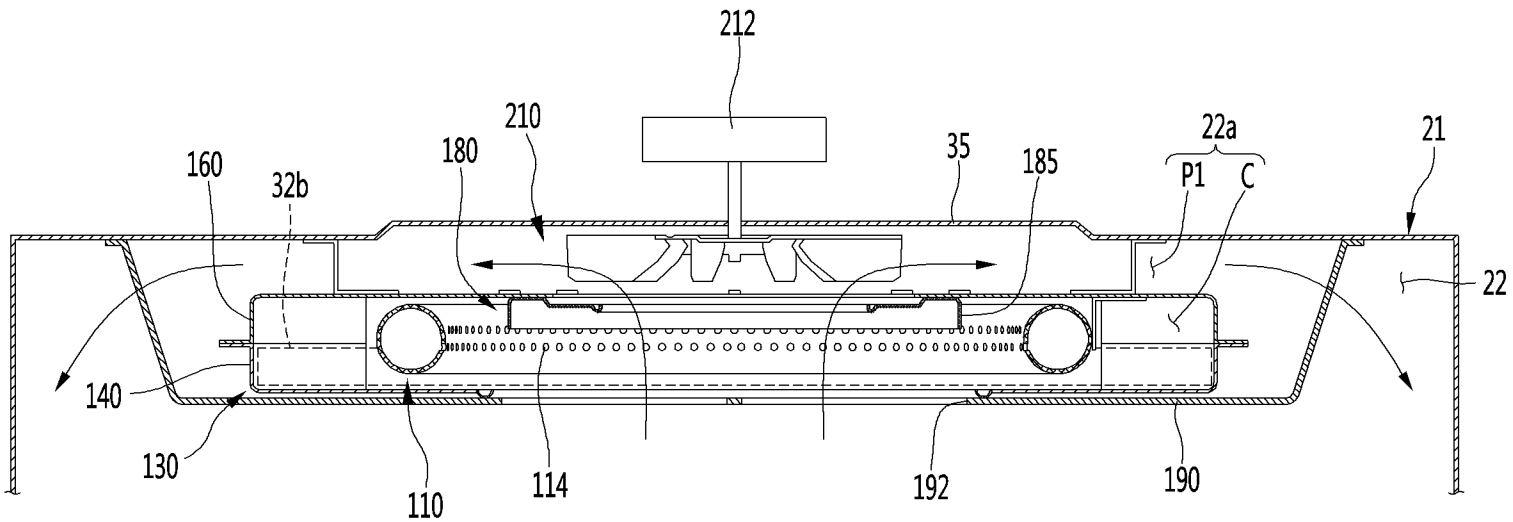
FIG. 6 is a view illustrating a flow of air in the cooking device according to the first embodiment.
Figure 7:
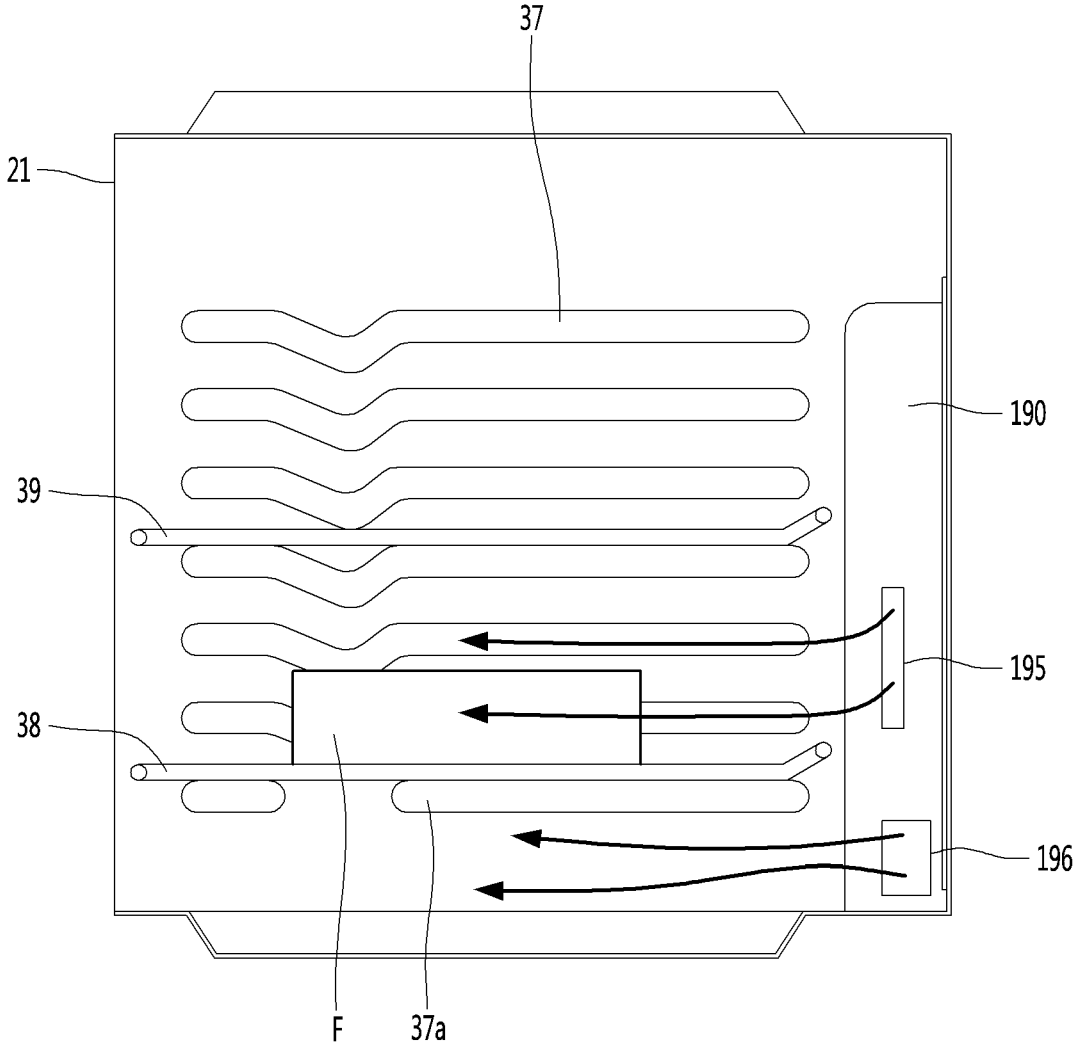
FIG. 7 is a view illustrating a flow of air while a plurality of trays are located in a cooking chamber according to the first embodiment.

FIG. 5 is a perspective view of a partitioning plate according to the first embodiment, FIG. 6 is a view illustrating a flow of air in the cooking device according to the first embodiment, and FIG. 7 is a view illustrating a flow of air while a plurality of trays are located in a cooking chamber according to the first embodiment.

Referring to FIGS. 4 to 7, the partitioning plate 190 according to the embodiment may divide an inner space of the frame 21 into the cooking chamber 22 and an air flow chamber 22*a*.

That is, the rear wall 35 of the frame 21 and the partitioning plate 190 may form the air flow chamber 22*a*.

Further, the burner device 100 and the fan 210 may be located in the air flow chamber 22*a*. Further, the burner cover 130 may form a combustion chamber C, and the burner 110 may be located in the combustion chamber C.

The fan 210 may be located between the burner cover 130 and the rear wall 351 of the frame 21.

A plurality of supporting parts 37 may be provided at one or more walls of both of the sidewalls 31 of the frame 21 for supporting trays 38 and 39 on which food is put. The plurality of supporting parts 37 are vertically separated from each other and arranged, and may protrude from one or more walls of both of the sidewalls 31 of the frame 21 to the cooking chamber 22, or may be recessed to accommodate the trays 38 and 39.

As the plurality of supporting parts 37 are provided at the frame 21, the plurality of trays 38 and 39 may be accommodated in the frame 21. In this case, two or more types of food may be separately put on the trays 38 and 39.

The partitioning plate 190 may include a front plate 191.

An air suction port 192 through which air flows may be provided in the front plate 191. The air suction port 192 may include a plurality of air holes, and each height or width of the plurality of air holes may be formed to have a size less than that of a user's finger.

One or more forming parts 193 for reinforcing strength and reducing thermal deformation may be provided on the front plate 191.

Although not limited to locations, one or more forming parts may be located at a left side of the air suction port 192, and one or more forming parts may be located at a right side of the air suction port 192.

Further, one or more forming parts may be located at one or more sides of upper and lower sides of the air suction port 192.

The partitioning plate 190 may further include an extension part 194 extending from the front plate 191 toward the rear wall 35 of the frame 21 and a contact part 197 bent from the extension part 194.

One or more air outlets 195 and 196 for discharging air heated by the burner device 100 to the cooking chamber 22 may be provided in the extension part 194.

The one or more air outlets 195 and 196 may include a first air outlet 195 and a second air outlet 196 which are vertically separated from each other and disposed.

The second air outlet 196 may be located at a lower level than the first air outlet 195. For example the entire second air outlet 196 may be located under the first air outlet 195.

Further, at least a part of the second air outlet 196 may be located at a lower level than the air suction port 192. For example, the entire second air outlet 196 may be located at a lower level than the air suction port 192.

A vertical length of the first air outlet 195 may be greater than that of the second air outlet 196. In this case, the air discharged from the first air outlet 195 may uniformly flow in a vertical direction of the frame 21.

For example, while the tray 38 is supported by a lowermost supporting part 37*a* of the plurality of supporting parts 37, at least a part of the first air outlet 195 may be located above the tray 38.

Further, in order to prevent the air discharged from the first air outlet 195 from being introduced into the air suction port 192 without heating food, a highest point 195*a* of the first air outlet 195 may be located at a lower level than a highest point 192*a* of the air suction port 192.

While the tray 38 is supported by the lowermost supporting part 37*a*, at least a part of the second air outlet 196 may be located at a lower level than the tray 38. Alternatively, while the partitioning plate 190 is installed at the frame 21, at least a part of the second air outlet 196 may be located at a lower level than the lowermost supporting part 37*a* of the plurality of supporting parts 37 provided on the frame 21.

Therefore, while the tray 38 is supported by the lowermost supporting part 37*a* of the plurality of supporting parts 37 as shown in FIG. 7, air discharged from the second air outlet 196 flows under the tray 38 and a lower side of food F put on the tray 38 may be heated.

In the embodiment, in order to sufficiently heat the lower side of the food F by the air discharged from the second air outlet 196, a width (i.e., a lateral length) of the second air outlet 196 may be greater than that of the first air outlet 195.

The contact part 197 may be in contact with the rear wall 35 of the frame 21. A fastening hole 198 to which a fastening member, which is not shown, is coupled may be provided in the contact part 197.

While the partitioning plate 190 is coupled with the rear wall 35 of the frame 21 by the fastening member, a lower end of the partitioning plate 190 may be in contact with the bottom wall 32 of the frame 21. That is, lower ends of the front plate 191 and the extension part 194 may be in contact with the bottom wall 32 of the frame 21.

However, in a process of coupling the partitioning plate 190 with the rear wall 35 of the frame 21, in some cases, the lower end of the partitioning plate 190 may be separated from the bottom wall 32 of the frame 21. In this case, air may leak through a gap between the lower end of the partitioning plate 190 and the bottom wall 32 of the frame 21.

In the embodiment, in order to prevent a gap from being generated between the lower end of the partitioning plate 190 and the bottom wall 32 of the frame 21, one or more of the front plate 191 and the extension part 194 may include a contact rib 199 to be in contact with the bottom wall 32 of the frame 21. The contact rib 199 may extend from the lower end of the partitioning plate 190 toward the frame 21 or the door 25.

Here, the contact rib 199 may extend obliquely downward from the frame 21 so that a contact state of the contact rib 199 and the bottom wall 32 of the frame 21 is maintained.

Meanwhile, an air suction hole 32*b* through which air is introduced into the combustion chamber C may be formed in the bottom wall 32 of the frame 21.

The air suction hole 32*b* is covered by the burner assembly 23 to prevent the air suction hole 32*b* from being exposed to the cooking chamber 22. Therefore, it may prevent foreign materials in the cooking chamber 22 from passing through the air suction hole 32*b*.

Of course, in the embodiment, as long as the air suction hole 32*b* is prevented from being exposed to the outside, the air suction hole 32*b* is not limited to the location thereof, and may also be located at the rear wall 35 or one sidewall of both of the sidewalls 31 of the frame 21.

Hereinafter, a flow of air in the cooking device according to the embodiment will be described.

When the heating of food is needed of the burner assembly 23, a gas is injected from the nozzle holder 220 to the burner 110. Then, air around the supply part 120 (air outside the frame) together with the gas is supplied to the burner 110. At this point, since low pressure is formed around the gas supplied to the burner 110, the air around the burner 110 is naturally supplied to the burner 110 due to a pressure difference (in a natural ventilation method).

Therefore, when the air is supplied to the burner 110 in the natural ventilation method, the air necessary to burn the gas may not be sufficiently supplied to the burner 110. In this case, the mixed gas in which the gas and the air are mixed may be incompletely burned in the burner 110, and thus an amount of carbon monoxide may be increased due to the incomplete combustion.

However, according to the present invention, since the air suction hole 32*b* is located in the bottom wall 32 of the frame 21, additional air for burning the mixed gas of the burner 110 may be introduced into the combustion chamber C.

The additional air introduced into the combustion chamber C may flow toward the burner 110.

Therefore, the air introduced into the combustion chamber C may smoothly flow toward the gas discharge holes 114 formed in the burner 110.

Meanwhile, while the mixed gas is supplied to the burner 110, the mixed gas is ignited by the ignition unit 230, and a flame is generated from the burner 110. Further, the fan motor 212 is turned on and the fan 210 is rotated.

When the fan 210 is rotated, the air inside the cooking chamber 22 is introduced into the combustion chamber C through the air suction port 192 of the partitioning plate 190. At this point, the air introduced into the combustion chamber C passes through an area formed by an inner circumferential surface 112 of the burner 110.

The air introduced into the combustion chamber C is heated by the flame generated from the burner 110, and then discharged from the combustion chamber C.

The air discharged from the combustion chamber C flows through an exhaust path P1 between the second cover 160 and the rear wall 35 of the frame 21, and then is discharged into the cooking chamber 22 through the air outlets 195 and 196 of the partitioning plate 190.

In the case of the embodiment, the burner cover 130 independently forms the combustion chamber C, and the combustion chamber C and the exhaust path P1 are divided by the burner cover 130.

Therefore, the air flowing through the exhaust path P1 may be prevented from being reintroduced into the combustion chamber C.

According to the proposed invention, a burner assembly may be coupled to the rear wall or one sidewall of the frame. That is, since the burner assembly is not located under the frame, the burner assembly is installed at the rear wall or one sidewall of the frame, and accordingly, a recessed part recessed under the bottom wall of the frame is able to be formed, the capacity of the frame may be increased.

Further, since an opening exposed to the outside does not exist at the bottom wall of the frame, foreign materials may be prevented from passing through the frame.

Further, since a vertical length of the first air outlet of the partitioning plate is greater than that of the second air outlet, the air discharged from the first air outlet may be uniformly discharged in a vertical direction of the frame.

Further, since the second air outlet is located at a lower level than the tray while the tray is supported by the lowermost supporting part, the air discharged from the second air outlet flows under the tray, and then a lower side of food put on the tray may be heated.

Figure 8:
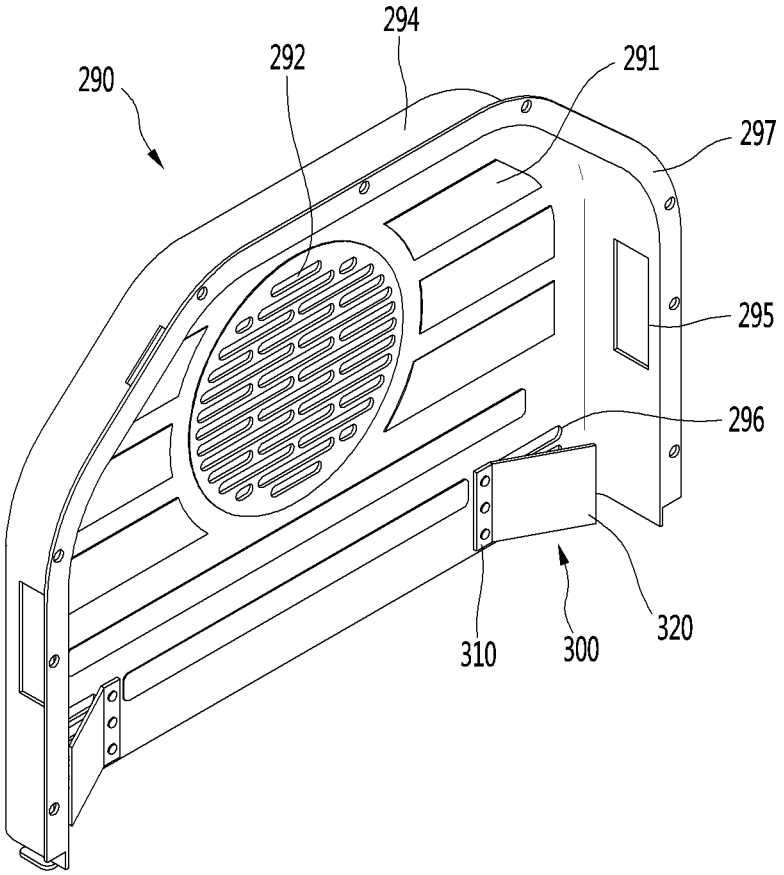
FIG. 8 is a perspective view of a partitioning plate according to a second embodiment.
Figure 9:
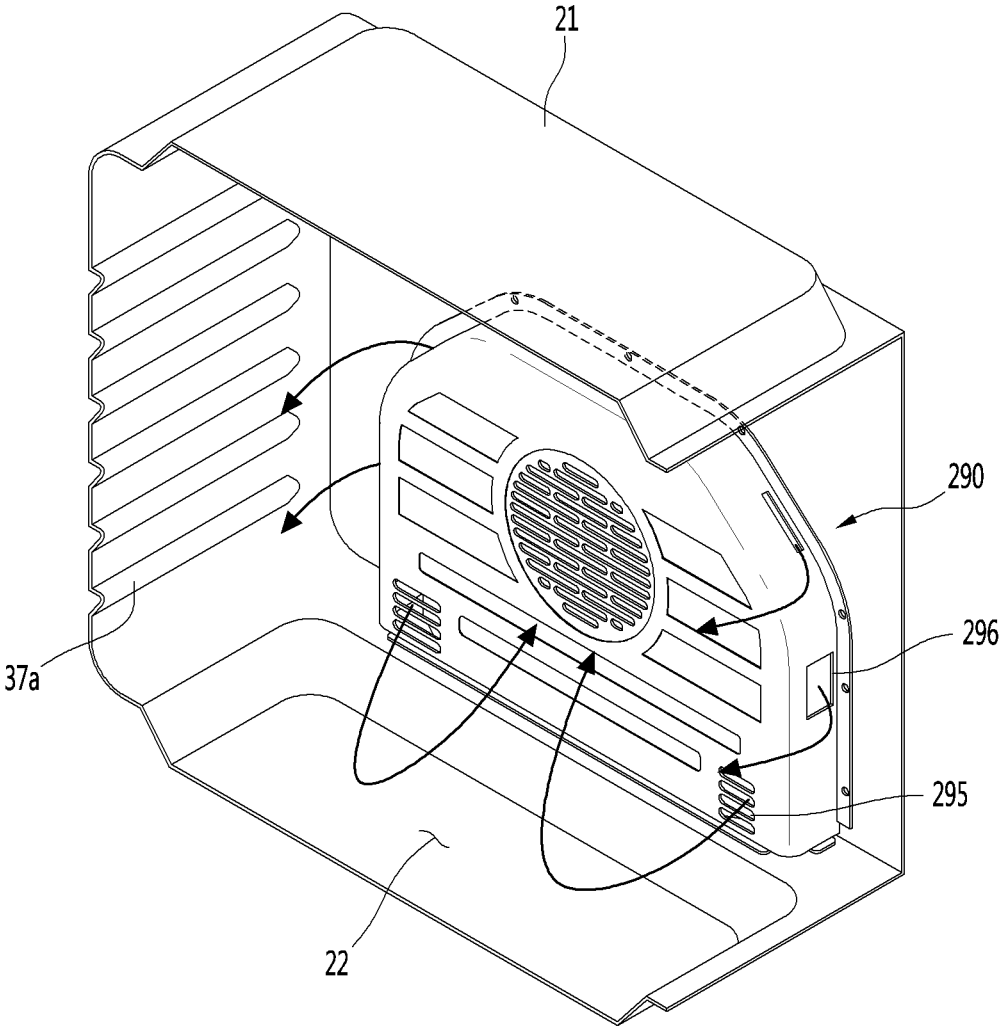
FIG. 9 is a view illustrating a flow of air in a cooking device according to the second embodiment.

FIG. 8 is a perspective view of a partitioning plate according to a second embodiment, and FIG. 9 is a view illustrating a flow of air in a cooking device according to the second embodiment.

In the embodiment, a structure of a partitioning plate and a flow of air based on the structure are different from those of the first embodiment and other things are the same as those of the first embodiment. Therefore, only specific features of the embodiment will be described below and descriptions of parts the same as those of the first embodiment will be omitted.

Referring to FIGS. 8 and 9, a partitioning plate 290 according to the embodiment may include a front plate 291 provided with an air suction port 292.

The partitioning plate 290 may further include an extension part 294 extending from the front plate 291 to the rear wall of the frame 21, and a contact part 297 bent from the extension part 294.

The partitioning plate 290 may further include a plurality of air outlets 295 and 296. The plurality of air outlets 295 and 296 may include a first air outlet 295 and a second air outlet 296 which are vertically separated from each other and disposed.

The second air outlet 296 may be located at a lower level than the first air outlet 295.

For example, the first air outlet 295 may be provided in the extension part 294, and the second air outlet 296 may be provided in the front plate 291.

The second air outlet 296 may be located at a lower level than the air suction port 292 in the front plate 291.

Although not limited to the above arrangement, two or more second air outlets 296 may be horizontally separated from each other and disposed in the front plate 291. For example, at least a part of the air suction port 292 may be located in a region corresponding to a region between the two second air outlets 296.

A height relationship between the second air outlet 296 and a lowermost supporting part 37*a* and a height relationship between the first air outlet 295 and the lowermost supporting part 37*a* may be the same as the first embodiment, and thus detailed descriptions thereof will be omitted.

The partitioning plate 290 may further include a flow guide 300 which guides a flow of air discharged through the second air outlet 296.

The flow guide 300 guides the air discharged from the second air outlet 296 to flow to the center of a lower portion of the cooking chamber 22. Therefore, since heated air flows upward from the center of the lower side regardless of a location of the tray in the cooking chamber, food may be cooked quickly.

The flow guide 300 may include a fastening part 310 to be coupled to the partitioning plate 190, and a guide part 320 which extends from the fastening part 310 and guides a flow of air to be discharged through the second air outlet 296.

The fastening part 310 may be connected to the partitioning plate 290 by hooks, or may be connected to the partitioning plate 290 by screws.

For example, the fastening part 310 may be coupled to a rear surface of the front plate 291. The guide part 320 extends toward the extension part 294 and is inclined toward the rear thereof. Therefore, the flow guide 300 is located in the air flow chamber. Further, the guide part 320 may be obliquely disposed with respect to each of the front plate 291 and the extension part 29.

Further, at least a part of the guide part 320 may be disposed to overlap the second air outlet 296 in a forward and backward direction.

Figure 10:
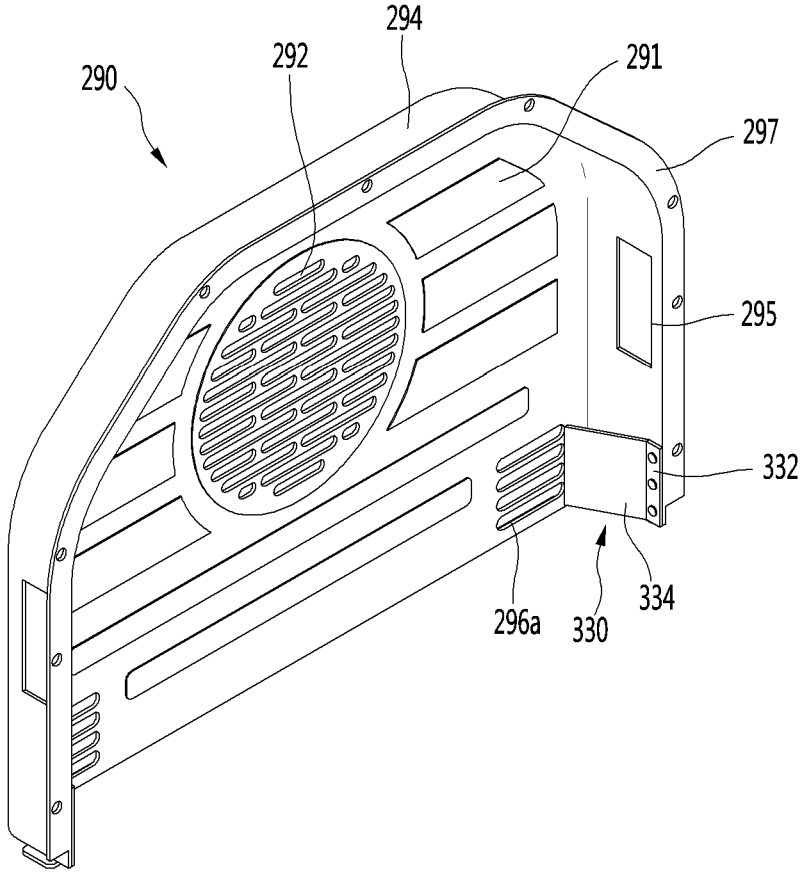
FIG. 10 is a perspective view of a partitioning plate according to a third embodiment.

FIG. 10 is a perspective view of a partitioning plate according to a third embodiment.

In the embodiment, a structure of a guide in a partitioning plate is different from that of the second embodiment and other things are the same as those of the second embodiment. Therefore, only specific features of the embodiment will be described below and descriptions of parts the same as those of the second embodiment will be omitted.

Referring to FIG. 10, a partitioning plate 290 according to the embodiment may include a flow guide 330 to be coupled to an extension part 294. The flow guide 330 may include a fastening part 332 to be coupled to the extension part 294, and a guide part 334 extending from the fastening part 332 toward a second air outlet 296*a*.

The guide part 334 may obliquely extend toward the second air outlet 296*a*. As another example, the fastening part 332 may be coupled to a front plate 291.

The guide part 334 may be obliquely disposed with respect to each of the front plate 291 and the extension part 294. Further, the guide part 334 may have a planar or rounded surface.

Figure 11:
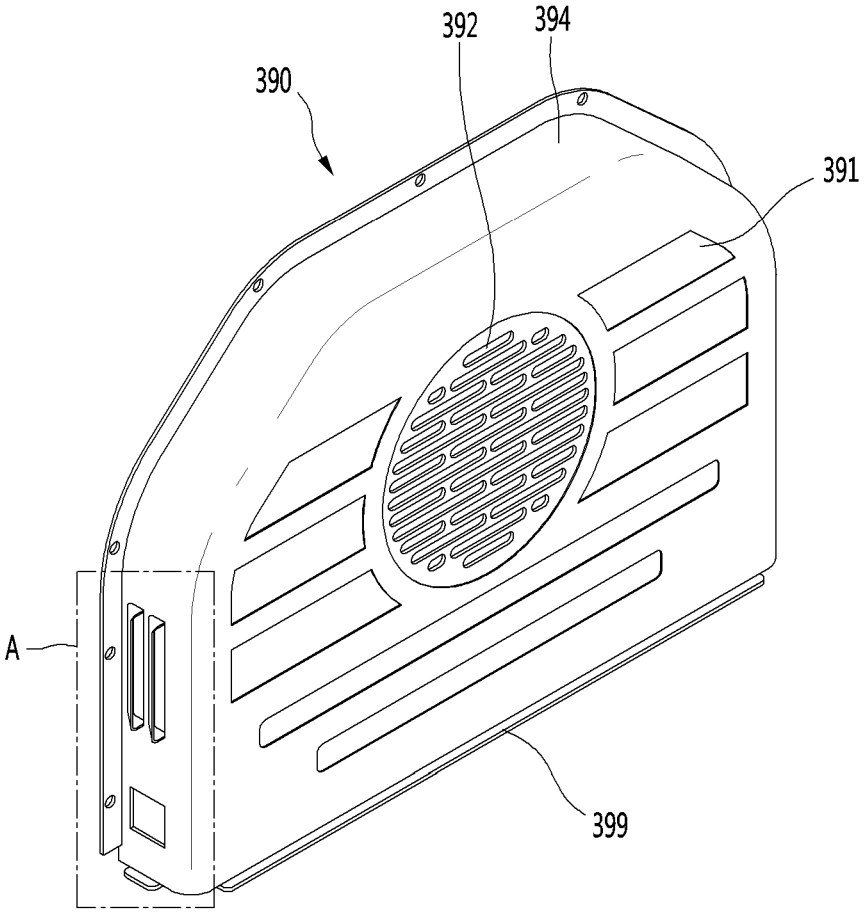
FIG. 11 is a perspective view of a partitioning plate according to a fourth embodiment.
Figure 12:
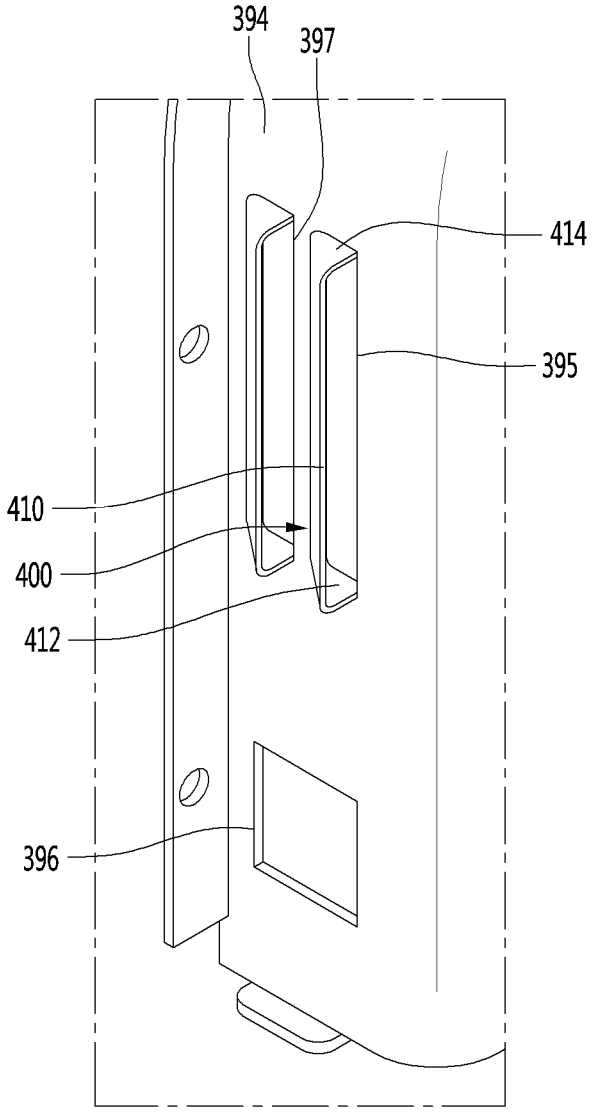
FIG. 12 is an enlarged view of portion A shown in FIG. 11.

FIG. 11 is a perspective view of a partitioning plate according to a fourth embodiment, and FIG. 12 is an enlarged view of portion A shown in FIG. 11.

In the embodiment, a structure of a guide in a partitioning plate is different from that of the second embodiment and other things are the same as those of the second embodiment. Therefore, only specific features of the embodiment will be described below and descriptions of parts the same as those of the second embodiment will be omitted.

Referring to FIGS. 11 and 12, a partitioning plate 390 according to the embodiment may include a front plate 391 provided with an air inlet 392.

The partitioning plate 390 may further include an extension part 394 extending from the front plate 391.

The extension part 394 may include a plurality of air outlets 395, 396, and 397.

The plurality of air outlets 395, 396, and 397 may include a first air outlet 395, a second air outlet 396 vertically separated from the first air outlet 395 and disposed, and a third air outlet 397 horizontally separated from the first air outlet 395 and disposed.

For example, the second air outlet 396 may be located under the first air outlet 395.

For example, the third air outlet 397 may be separated from the first air outlet 395 in a forward and backward direction and disposed. A height of at least one point of the third air outlet 397 may be equal to a height of one point of the first air outlet 395. In FIG. 12, for example, the same heights from a lower end of the partitioning plate 390 to the first and third air outlets 395 and 397 are illustrated.

A height relationship between the second air outlet 396 and a lowermost supporting part of a plurality of supporting parts in the frame may be the same as that described with reference to the first embodiment, and thus a detailed description thereof will be omitted.

Vertical lengths of one or more of the first air outlet 395 and third air outlet 397 may be greater than a vertical length of the second air outlet 396. A width of the second air outlet 396 may be greater than widths of one or more of the first air outlet 395 and third air outlet 397.

The partitioning plate 390 may further include a flow guide 400 which guides a flow of air discharged from one or more of the first and third air outlets 395 and 397.

For example, FIG. 12 shows that the air discharged from each of the first and third air outlets 395 and 397 is guided by the flow guide 400.

The flow guide 400 may further include a guide part 410 obliquely extending from the extension part 394, and connecting parts 412 and 414 which connect upper and lower ends of the guide part 410 to the extension part 394.

When the partitioning plate 390 is located in a cooking chamber, the guide part 410 may obliquely extend from the frame 21 toward a front side thereof.

According to the embodiment, the air discharged from one or more of the first and third air outlets 395 and 397 flows along the flow guide 400, then the air flows toward the door, and thus the air may be uniform in the cooking chamber.

The partitioning plate 390 may further include a contact rib 399 to be in contact with the bottom wall 32 of the frame 21. The contact rib 399 may extend from a lower end of the partitioning plate 390 toward the frame 21 or the door 25.

Although the cooking device is described to include one oven unit in the above embodiments, in the case of a cooking device provided with a plurality of oven units arranged in a vertical or lateral direction, a burner assembly may be provided in some or each of the plurality of oven units.

Even though all the elements of the embodiments are coupled into one or operated in the combined state, the present disclosure is not limited to such an embodiment. That is, all the elements may be selectively combined with each other without departing from the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in a descriptive sense only and not for purposes of limitation, and also the technical scope of the invention is not limited to the embodiments. Furthermore, the present invention is defined not by the detailed description of the invention but by the appended claims, and all differences within the scope will be construed as being comprised in the present disclosure.

What is claimed is:

1. A cooking device comprising:

a frame configured to accommodate food and including a rear wall;

a partitioning plate configured to divide an inner space of the frame into a cooking chamber and an air flow chamber in the frame and including a front plate, wherein the front plate comprises an air inlet configured to introduce air in the cooking chamber into the air flow chamber;

a burner disposed in the burner cover; and a fan disposed in the air flow chamber, wherein the partitioning plate further comprises:

an extension part configured to extend from the front plate toward the rear wall of the frame;

first and second air outlets configured to discharge air heated by the burner disposed in the burner cover to the cooking chamber and provided in the front plate, and spaced apart from each other in a horizontal direction;

a first flow guide coupled to a rear surface of the front plate and to guide a flow of air that has passed the opening of the burner cover to be discharged through the first air outlet; and a second flow guide coupled to the rear surface of the front plate to guide a flow of air that has passed the opening of the burner cover to be discharged through the second air outlet and spaced apart from the first flow guide, wherein each of the first and second flow guides comprises:

a fastening part to be coupled to the front plate; and a guide part which extends from the fastening part and is obliquely disposed with respect to each of the front plate and the extension part, wherein the extension part comprises a first lateral wall and a second lateral wall facing the second lateral wall, wherein the first flow guide is disposed closer to the first lateral wall than to the second flow guide, and the second flow guide is disposed closer to the second lateral wall than to the first flow guide, wherein the guide part of the first flow guide extends toward the first lateral wall, and the guide part of the second flow guide extends toward the second lateral wall.

2. The cooking device of claim 1, wherein each fastening part of the first and second flow guides coupled a surface of the front plate between the first and second air outlets.

3. The cooking device of claim 2, wherein each of the first and second air outlets comprises a plurality of openings spaced apart from each other in a vertical direction.

4. The cooking device of claim 1, wherein an end of the guide part of the first flow guide is spaced apart from the first lateral wall and the air in the air flow chamber flows a space between the end of the guide part of the first flow guide and the first lateral wall and then being discharged through the first air outlet, and an end of the guide part of the second flow guide is spaced apart from the second lateral wall and the air in the air flow chamber flows a space between the end of the guide part of the second flow guide and the second lateral wall and then being discharged through the second air outlet.

5. The cooking device of claim 1, wherein the first lateral wall comprises a first lateral air outlet and the second lateral wall includes a second lateral air outlet, wherein the first and second lateral air outlets are positioned higher than the first and second flow guides.

6. The cooking device of claim 1, wherein the first and second air outlets is positioned lower than the air inlet.

7. The cooking device of claim 6, wherein the guide part of the first flow guide horizontally extends toward the first lateral wall, and the guide part of the second flow guide horizontally extends toward the second lateral wall.

8. The cooking device of claim 6, wherein each fastening part of the first and second flow guides is positioned lower than the air inlet.

9. A cooking device comprising:

a frame configured to accommodate food and including a rear wall;

a partitioning plate configured to divide an inner space of the frame into a cooking chamber and an air flow chamber in the frame and including a front plate, wherein the front plate comprises an air inlet configured to introduce air in the cooking chamber into the air flow chamber;

a burner cover disposed between the front plate of partitioning plate and the rear wall of the frame and including an opening through which air introduced through the air inlet passes;

a burner disposed in the burner cover; and a fan disposed in the air flow chamber, wherein the partitioning plate further includes:

an extension part configured to extend from the front plate toward the rear wall of the frame;

first and second air outlets configured to discharge air heated by the burner disposed in the burner cover to the cooking chamber and provided in the front plate, and spaced apart from each other in a horizontal direction;

a first flow guide coupled to the extension part and to guide a flow of air that has passed the opening of the burner cover to be discharged through the first air outlet; and a second flow guide coupled to the extension part to guide a flow of air that has passed the opening of the burner cover to be discharged through the second air outlet and spaced apart from the first flow guide, wherein each of the first and second flow guides comprises:

a fastening part configured to be coupled to the extension part; and a guide part which extends from the fastening part toward the front plate and is obliquely disposed with respect to each of the front plate and the extension part.

10. The cooking device of claim 9, wherein the extension part comprises a first lateral wall and a second lateral wall facing the second lateral wall, wherein the first flow guide is disposed closer to the first lateral wall than to the second flow guide, and the second flow guide is disposed closer to the second lateral wall than to the first flow guide, and wherein the fastening part of the first flow guide is coupled to the first lateral wall and the fastening part of the second flow guide is coupled to the second lateral wall.

11. The cooking device of claim 10, wherein the guide part of the first flow guide extends toward the first air outlet and the guide part of the second flow guide extends toward the second air outlet.

12. The cooking device of claim 10, wherein the first lateral wall comprises a first lateral air outlet and the second lateral wall includes a second lateral air outlet, wherein the first and second lateral air outlets are positioned higher than the first and second flow guides.

13. The cooking device of claim 9, wherein each of the first and second air outlets comprises a plurality of openings spaced apart from each other in a vertical direction.

14. The cooking device of claim 9, wherein the first and second air outlets is positioned lower than the air inlet.

15. The cooking device of claim 14, wherein the guide part of the first flow guide horizontally extends toward the front plate, and the guide part of the second flow guide horizontally extends toward the front plate.

16. The cooking device of claim 14, wherein each guide part of the first and second flow guides is positioned lower than the air inlet.

* * * * *